United States Patent [19]

Yin-Lung

[11] 4,267,900

[45] May 19, 1981

[54] EMERGENCY ESCAPE SYSTEM

[76] Inventor: Yang Yin-Lung, P.O. Box 865, Kaohsiung, Taiwan

[21] Appl. No.: 60,134

[22] Filed: Jul. 24, 1979

[51] Int. Cl.[3] ..... A62B 1/02; A62B 3/00

[52] U.S. Cl. ..... 182/13; 182/36; 182/48

[58] Field of Search ..... 182/36, 3, 48, 82, 19, 182/12–14; 105/64, 63, 79

[56] References Cited

U.S. PATENT DOCUMENTS

| | | | |
|---|---|---|---|
| 308,444 | 11/1884 | Terwilliger | 182/82 |
| 607,161 | 7/1898 | Conaway | 182/82 |
| 3,944,021 | 3/1976 | Smith | 182/3 |
| 4,125,172 | 11/1978 | Hatala | 182/36 |

*Primary Examiner*—Reinaldo P. Machado

[57] ABSTRACT

An emergency escape system designed for use with multistory buildings. The system comprises generally a vertical zigzag track formed by a plurality of special contour structures, each structure having three plies of plate mounted in parallel relationship adjacent to outside wall of the building and having a plurality of parallel branch tracks extending laterally and slightly upwardly from the vertical track to an exit tunnel at each floor of the building. A number of loader cars for carrying escapees or properties from each exit tunnel along the track to escape, each car having four universal wheels underneath the bottom of the car and two parallel axles perpendicularly fixed at the upper and the lower end back side of the car, a set of several ball bearing rollers connected each other by specially curved springs is rotatorily mounted on each axle for supporting and traveling along the tracks. A group of special contour retaining bars pivotly mounted between the parallel plates of the track for automatic sequence control of the traveling cars. A spring damper located at each turning point or corner of the track for dampening the speed of the traveling car.

3 Claims, 6 Drawing Figures

FIG. 3
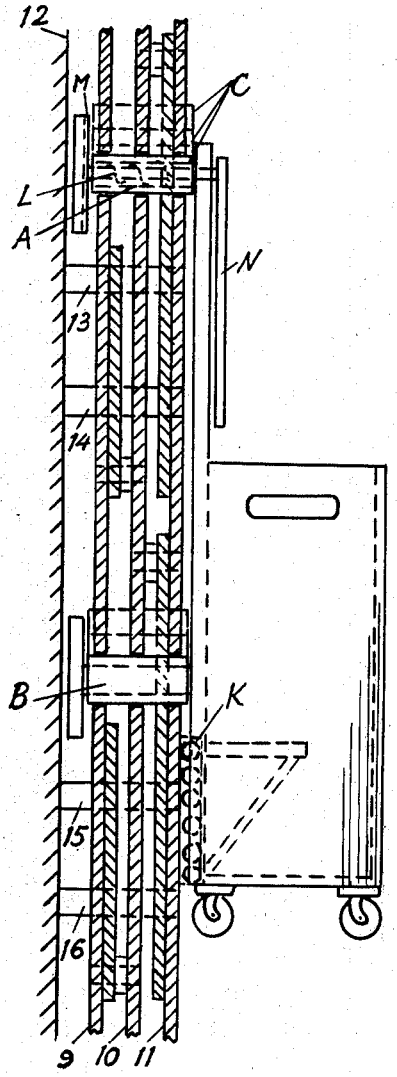
FIG. 4
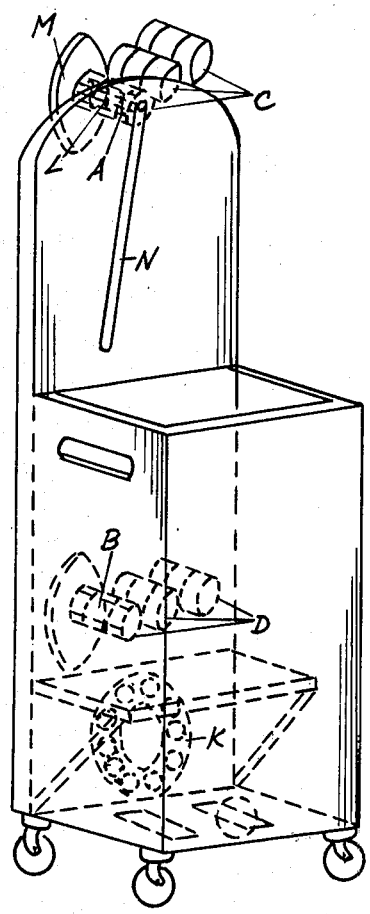
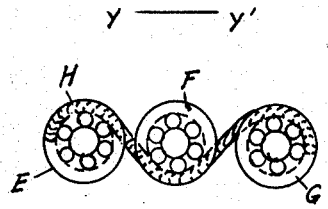
FIG. 6
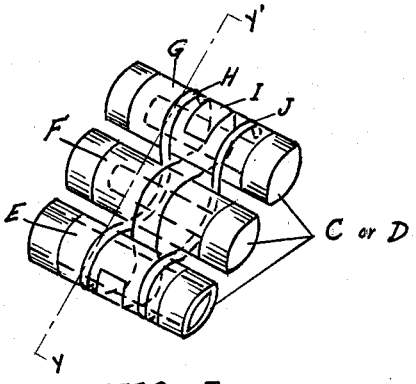
FIG. 5

EMERGENCY ESCAPE SYSTEM

BACKGROUND OF THE INVENTION

This invention relates particularly to improvement in emergency escape in addition to applicant's previous patent applications, entitled "Gliding cars and track type high building emergency escape device", Ser. No. 842,271 filed Sept. 3, 1977 and now U.S. Pat. No. 4,207,965, and Ser. No. 765,210 filed Feb. 2, 1977 and now abandoned respectively.

One of the object in view is the provision of an additional axle at the lower end back side of a loader car in cooperation with the original axle at the upper end back side of the loader car for supporting and sliding downwardly along the same tract at a same time to prevent the car from possibly swinging on a single axle during the downward travel.

Another object of the invention is the provision of double axles at the back side of the car for coordination with a group of retaining bars thereon the track for automatic sequence control.

Still another object of this invention is the construction of a set of ball bearing rollers mounted on each axle at the back side of the car, said rollers which are connected each other by three special curved springs acting as a governor to the retaining bars for automatic sequence control.

Still another object of this invention is the construction of the retaining bars which are spring loaded at one end while the other end of the retaining bars are urged in a position for temporarily holding still either one of the axles of the loader car when said axle is dampening on a spring damper thereby at each turning point or corner of the track to prevent the car from acceleration during the downward travel.

IN THE DRAWINGS

FIG. 3 is a side cross-sectional view of a loader car supporting on the track by two axles at the back side of the car.

FIG. 4 is a perspective view of a loader car.

FIG. 5 is a perspective view of a set of rotatable rollers which are connected together by three special curved springs in their circular grooves of the rollers.

FIG. 6 is a plan view of one of the special curved springs connecting in the circular grooves (dotted line) of the rollers taken along the line y-y' of FIG. 5.

Figures 1, 2:
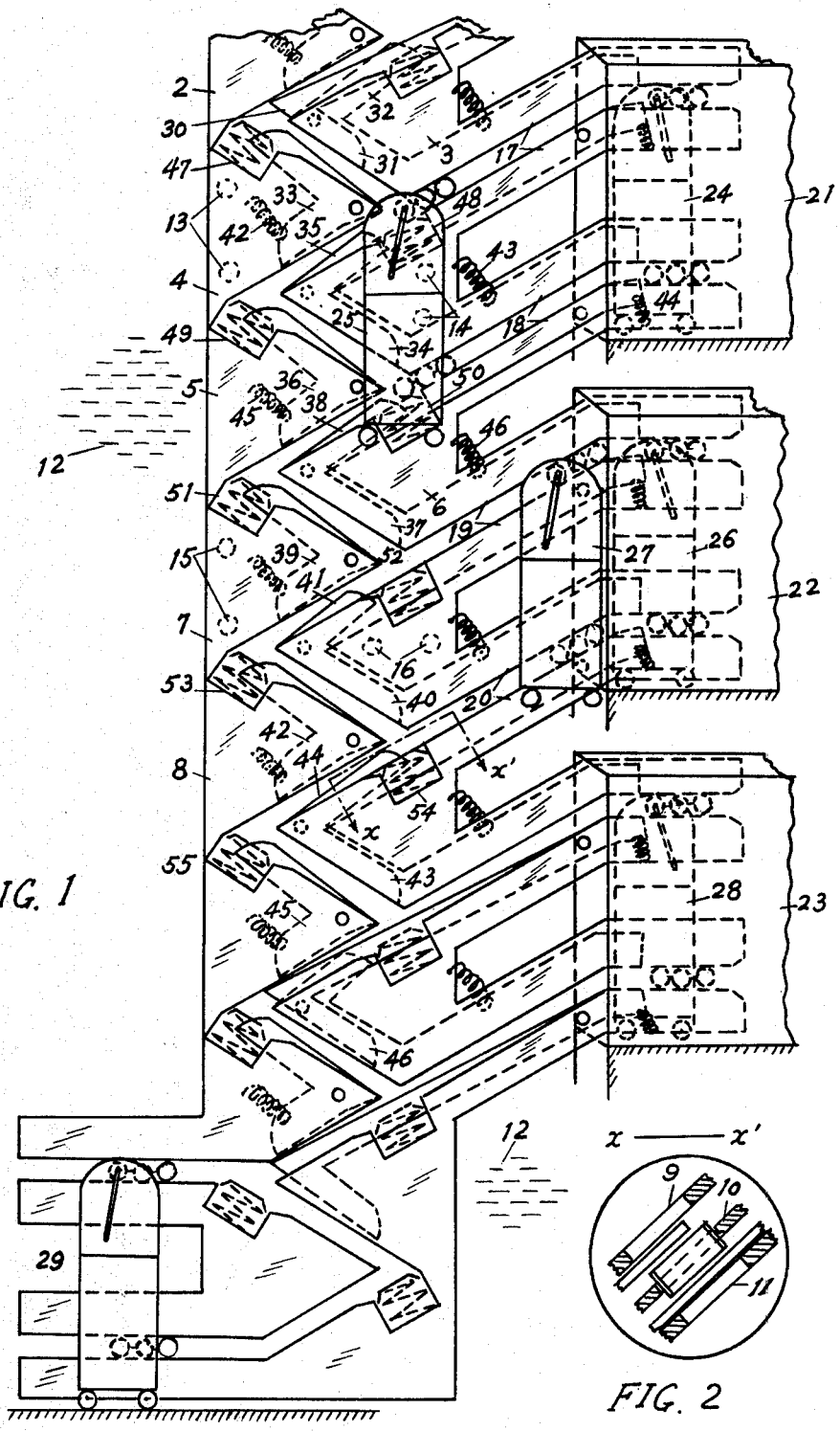
FIG. 1 is a perspective view of a portion of an emergency escape system secured to a building.
FIG. 2 is a transverse cross-sectional view, taken along the line x-x' of FIG. 1, showing the plan view of a portion of the track and retaining bars, in the middle showing a damper thereby.

As shown in FIG. 1 a vertical zigzag track 1 is formed by a plurality of special contour structures 2 to 8 etc. in proper arrangement, each structure having three plies of plate 9, 10, 11 in same contour being mounted in parallel relationship adjacent to outside wall of a multistory building by adequate fittings or joints 13 to 16 (better seen in FIG. 3). A plurality of branch track 17 to 20 etc. extending laterally and slightly upwardly from the vertical track to an exit tunnel 21, 22, or 23 at each floor of the building. A number of loader cars stored at proper location of each floor for carrying escapees or properties traveling along the track to escape. In FIG. 1 showing 5 of them 24 to 28 are in their positions ready to travel or in the downward traveling while another one 29 is just safely getting down to the ground. A plurality of retaining bars 30-46 etc. in particular contours are pivotly mounted between the parallel plates of the track serving as an automatic control to keep the traveling cars in proper distance and sequence. A spring loaded damper located at each turning point (better seen in FIG. 2) or corner of the zigzag track 47 to 54, or 55 is used for dampening the speed of the traveling cars. The said retaining bars are spring loaded at one end to off set the other end in the passage of the track serving for two purposes: one is to retain the car in following or the car at the opposite direction of the track from coming down at the same time of a preceeding car for automatic sequence control; the other purpose is that the said off set ends stand by each turning point or corner of the zigzag track are in cooperation with said respective spring dampers serving as stops for temporarily holding still the traveling cars at each turning point of the track to prevent the cars from acceleration in their downward travels. Each of said retaining bars 33, 36, 39, 42, 45 is installed with each of the retaining bars 34, 37, 40, 43, 46 respectively between the same parallel plates of the structure for cooperative retaining action, while the retaining bars 32, 35, 38, 41, 44 are installed between different plates in order to have no interference to the said retaining bars.

Each of the loader car having two parallel axles (A, B in FIG. 4) perpendicularly and firmly fixed at the upper and lower end back side of the loaded car in a same distance as the distance between two similar points of the track, each one of the axles having a set of ball bearing rollers C and D for supporting and traveling the car on the track. Each set of the rollers comprises at least three barrels E, F, G, each having three circular grooves on its periphery are connected each other by three curved leaf springs H, I, J in their respective circular groove for semi-rigid of the rollers as shown in FIG. 6. In such an arrangement, the sets of rollers follow the contour of the track and govern their respective retaining bars thereby during the downward travel giving an assistance to the sequence control. To avoid the sets of rollers from interfering to each other in the passage, the said retaining bar 33, 36, 39, 42, 45 are made of one arm shorter than the other arm of the retaining bar and one of the arm of the retaining bars 32, 38, 44 are made longer than the other arm of the retaining bars 35, 41 at intervals for the same reasons.

A rotatable ball ring K located at the lower back side of the car is used for counteracting the weight of the loader car horizontally acting on the wall and add free of movability of the car during its downward travel. The said upper axle is hollowed with worm threads in its center bore, a worm screw L protruds all the way through the hollowed center of said axle and connected to a lining brake disk M, said screw is operatable by a rocking lever N inside the car to bring said lining disk toward the back side of the car and clamps the track thereby for stopping or slowing down the traveling speed of the car in case of necessity.

The loader car is made of either foldable or fixed style in a desirable size with or without a top cover, the entrance of the exit tunnel is about the size of a loader car and the car can get in the exit tunnel one direction only to assure properly and safely rides on the track.

What I claim is:

1. A loader car for emergency escape used with a vertical zigzag track for multistory building comprising two parallel axles perpendicularly and firmly fixed at the upper and the lower end back side of the car in a same distance between said axles as the distance between any two similar points of the track for supporting and traveling the car with two axles on the track simultaneously, the track is formed by a plurality of special contour structures, each structure having three plies of plate mounted in parallel relationship adjacent to outside wall of the building and having a plurality of parallel branch tracks extending laterally and slightly upwardly from the vertical track to an exit tunnel at each floor of the building, means provided between the parallel plates of the track for automatic sequence control of the traveling cars, a spring damper located at each turning point of the track for dampening the speed of the traveling car.

2. A loader car for emergency escape according to claim 1 comprising two parallel axles porpendicularly and firmly fixed at the upper and the lower end back side of the car, a set of ball bearing rollers being rotatorily mounted on each axle for supporting and traveling the car with two sets of rollers on the track simultaneously, each set of the rollers consists of at least three barrels wherein said ball bearing rollers are rotatorily mounted, said barrels each having three circular grooves on its periphery are connected each other by three special curved springs in their respective circular groove for semi-rigid of the rollers to serving as an assistance to automatic sequence control for the traveling cars.

3. Apparatus for emergency escape according to claim 1 wherein, a group of special contour bars pivotly mounted between the parallel plates of the track is spring loaded at one end of each bar to off set the other end of each bar in the passage of the track, the said off set end of the bars are just long enough to reach and cooperate with said spring damper thereby at each turning point of the track for temporarily holding still the traveling cars to prevent the cars from acceleration in their downward travels.

* * * * *